United States Patent [19]

Lorenzelli et al.

[11] Patent Number: 4,619,572

[45] Date of Patent: Oct. 28, 1986

[54] TRANSFER DEVICE WITH A DOUBLE TIGHT BARRIER BETWEEN A CONTAINER AND A CONFINEMENT ENCLOSURE

[75] Inventors: Robert Lorenzelli, Saint-Remy-les-Chevreuses; Pierre Dabernard, Gif sur Yvette; Christian Maire, Bures-sur-Yvette, all of France

[73] Assignee: Cogema, Compagnie Generale des Matieres Nucleaires, Velizy-Villacoublay, France

[21] Appl. No.: 799,929

[22] Filed: Nov. 21, 1985

[30] Foreign Application Priority Data

Nov. 26, 1984 [FR] France ..... 84 17966

[51] Int. Cl.[4] ..... B65B 1/04

[52] U.S. Cl. ..... 414/217

[58] Field of Search ..... 414/217, 221

[56] References Cited

U.S. PATENT DOCUMENTS 4,532,970 8/1985 Tullis et al. ..... 414/217 X

FOREIGN PATENT DOCUMENTS 1449887 8/1966 France .
2112082 6/1972 France .
2462769 2/1981 France .
64075 4/1972 Luxembourg .

*Primary Examiner*—Robert J. Spar
*Assistant Examiner*—Stuart J. Millman

[57] ABSTRACT

A transfer device between a container and a confinement enclosure comprises a chamber having an opening issuing to the outside and an opening issuing into the enclosure. These openings are closed by doors constituting with an external door and an internal door of the container, to double door transfer systems. In order to permit the engagement of the chamber door on the inner door of the container following the removal of the first double door, the opening is formed on a mobile skirt connected by a sealing bellows to the enclosure wall.

7 Claims, 4 Drawing Figures

TRANSFER DEVICE WITH A DOUBLE TIGHT BARRIER BETWEEN A CONTAINER AND A CONFINEMENT ENCLOSURE

BACKGROUND OF THE INVENTION

The present invention relates to a device making it possible to carry out the transfer of a random product or material, in one direction or the other, between a container used e.g. for the transportation or storage of the product in a so-called clean zone and a confinement enclosure constituting a working zone, said device leading to a permanent tight double barrier between these zones, in order to prevent any contamination of the clean zone.

Transfer devices of this type can be used in all cases where an enclosure is used for confining a zone contaminated by microscopically divided material. In the nuclear field, this zone can be a radioactive zone. In the pharmaceutical industry, it can contain toxic products. The invention applies to all these different fields of activity.

It is known to transfer a product, material or equipment between a container and a confinement enclosure by means of a double door, tight transfer device, like that described in French patent 2 040 616.

However, in certain circumstances, such a device is inadequate, because it only constitutes a single tight barrier, which is not always sufficiently reliable. Moreover, it is not suitable for systematic manipulations and does not make it possible to monitor the fact that the confinement is being maintained.

SUMMARY OF THE INVENTION

The present invention more particularly relates to a transfer device between a container and a confinement enclosure leading to a tight double barrier, whilst being designed in a particularly simple and easily realisable manner.

The present invention specifically proposes a transfer device with a double tight barrier between a container and a confinement enclosure, wherein it comprises a transfer chamber having a first opening issuing into the confinement enclosure and a second opening issuing out of said enclosure, the first and second openings normally being closed by first and second doors respectively; said container having an opening closed by an external door and by an internal door and which can be tightly engaged on the second opening of the chamber in order to link the latter with the container, following the removal of a first double door constituted by the external door of the container and by the second door of the chamber; and a movable wall common to the chamber and to the confinement enclosure, carrying the first opening of the chamber and whose displacement makes it possible to engage the latter tightly on the container opening, after removing the first double door, in order to link the container with the confinement enclosure after removing a second double door constituted by the inner door of the container and by the second door of the chamber.

Preferably, the mobile wall comprises a skirt, whereof one end defines the first opening of the chamber, the first and second openings of the chamber facing one another along a common axis, the skirt being mobile parallel to said axis and connected to the walls of the chamber and the enclosure by sealing means, more particularly constituted by a bellows.

In order to permit the fitting and removal of the first and second double doors, handling means can be provided respectively within the chamber and within the confinement enclosure.

According to another feature of the invention, a ventilation/filtration circuit communicates with the chamber and has means for checking the internal atmosphere of the chamber and consequently the seal between the zones.

BRIEF DESCRIPTION OF THE DRAWINGS

The invention is described in exemplified manner hereinafter relative to non-limitative embodiments and the attached drawings, wherein.

DETAILED DESCRIPTION OF THE PREFERRED EMBODIMENTS

Figure 1:
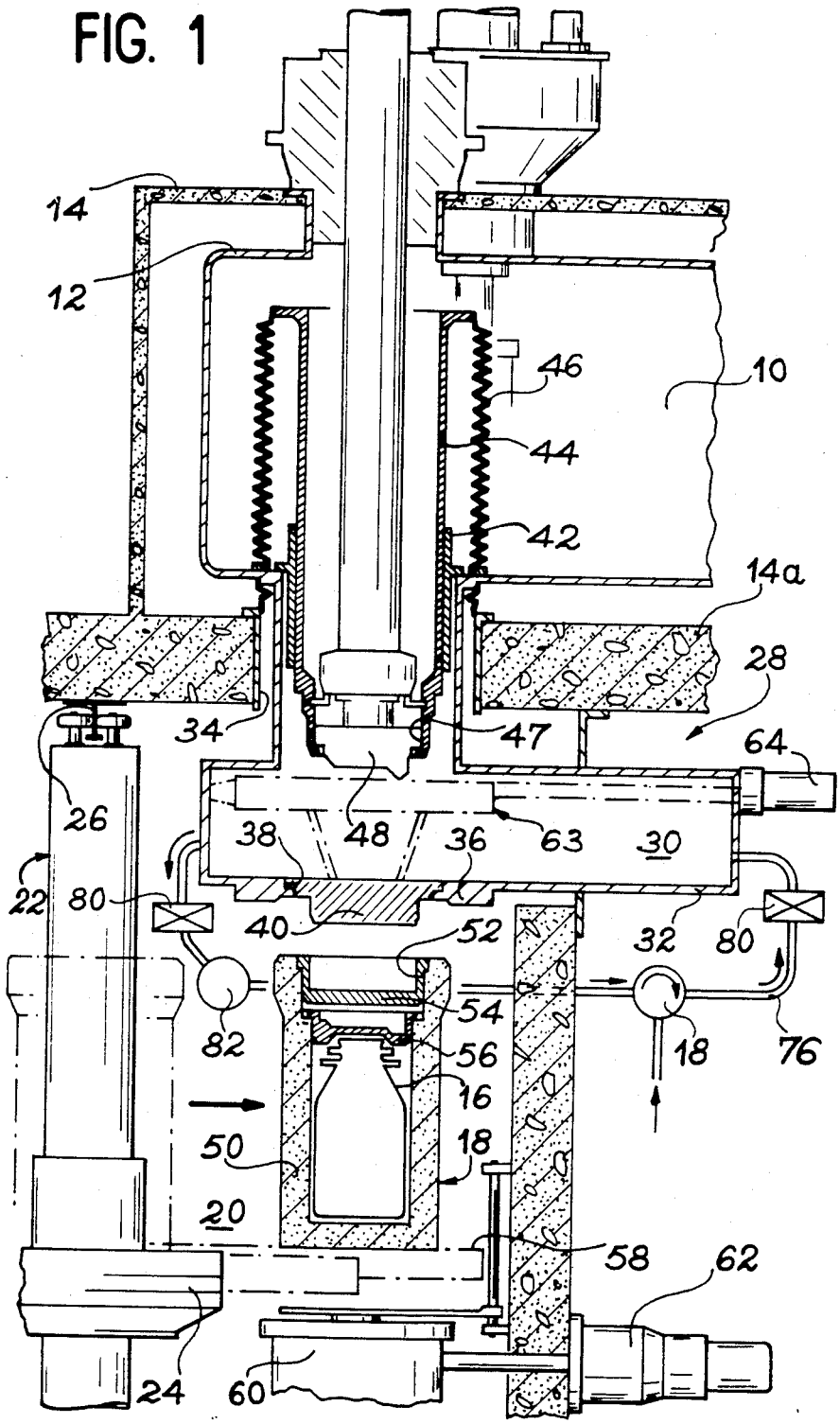
FIG. 1. A diagrammatic sectional view of a transfer device according to the invention, said device being shown in the position which it occupies before engaging the container on the door of the transfer chamber.

At the top of FIG. 1, it is possible to see part of a confinement enclosure 10 defined by an inner metal wall 12, duplicated by a concrete biological protection envelope 14.

In the nuclear installation shown in FIG. 1, enclosure 10 can in particular be an enclosure in which one or more operations are carried out on a radioactive product. For example, these operations can constitute stages of the production of nuclear fuels for supplying nuclear reactors.

In the embodiments shown in FIG. 1, the radioactive product to be introduced into enclosure 10 is contained in a contaminated jar 16, which is placed in a container 18, located in a storage and distribution cell 20, positioned below the part of enclosure 10 shown in the drawing and which constitutes an uncontaminated, clean zone.

In the present application to a production chain for nuclear fuels, cell 20 is in the form of a gallery, which can communicate by means of tight double barrier transfer devices 28 according to the invention with several confinement enclosures, such as enclosure 10. There is then no link between these enclosures and they are used for carrying out the various stages of the production of the fuel.

The storage and handling of the container 18 within cell 20 are carried out, in the embodiment shown in FIG. 1, with the aid of a so-called transstocker means 22 having plates 24 on which are stored the containers 18. Means 22 can move on rails 26 to bring any one of the containers 18 into a position facing a tight double barrier transfer device 28 according to the invention, in order to transfer said container into enclosure 10. where it overhangs the cell 20 at this point.

As illustrated in FIG. 1, transfer device 28 mainly comprises a transfer chamber 30, whereof the metal wall 32 constitutes a projection of wall 12 of enclosure 10, which projects downwards into the top of cell 20, passing through a passage 34 formed in the concrete floor 14*a* completing envelope 14 of confinement enclosure 10. The lower horizontal part of wall 32 of chamber 30 has a flange 36 defining a circular opening 38 normally closed by a door 40.

The part of wall 32 of chamber 30 passing through the passage 34 is substantially cylindrical and is positioned vertically above opening 38. By means of a guide bearing 42, it supports a cylindrical skirt 44 mobile along its vertical axis, which coincides with the axis of opening 38. The upper end of skirt 44, which is located inside the confinement enclosure 10, is tightly connected to the lower wall 12 of the latter by a sealing bellows 46. At its lower end penetrating chamber 30, skirt 44 defines an opening 47, which is normally closed by a door 48.

As a result of the configuration described herein before, a first sealing barrier is established between enclosure 10 and chamber 30 by skirt 44, bellows 46 and door 48, whilst a second sealing barrier is formed between chamber 30 and cell 20 by door 40.

Container 18 also constitutes an element of the transfer device according to the invention. To this end, container 18 has an envelope 50, whose upper end has an opening 52 normally closed by an external door 54 and an internal door 56.

In the position shown in FIG. 1 where doors 40 and 48 of the chamber are closed and where doors 54 and 56 of the container are also closed, remotely unlockable locking means (not shown) prevent any accidental opening of any of the doors.

The transfer of jar 16 from container 18 to the interior of confinement enclosure 10 will now be described with successive reference to FIGS. 1 to 4.

During a first operation illustrated by FIG. 1, container 18 is moved from plate 24 to below the chamber door 40, so that its vertical axis coincides with that of door 40. This operation is accomplished e.g. by means of fork, such as 58 belonging to means 58.

In this position, container 18 is positioned above a lifting mechanism 60 controlled by a motor 62. The putting into operation of lifting mechanism 60 has the effect of engaging the upper edge of container envelope 50 against the lower edge of flange 36 and simultaneously the outer door 54 of the container against the plug 40 of the chamber. These different components form a first tight double door transfer system, which can be realized by any known means.

Figure 2:
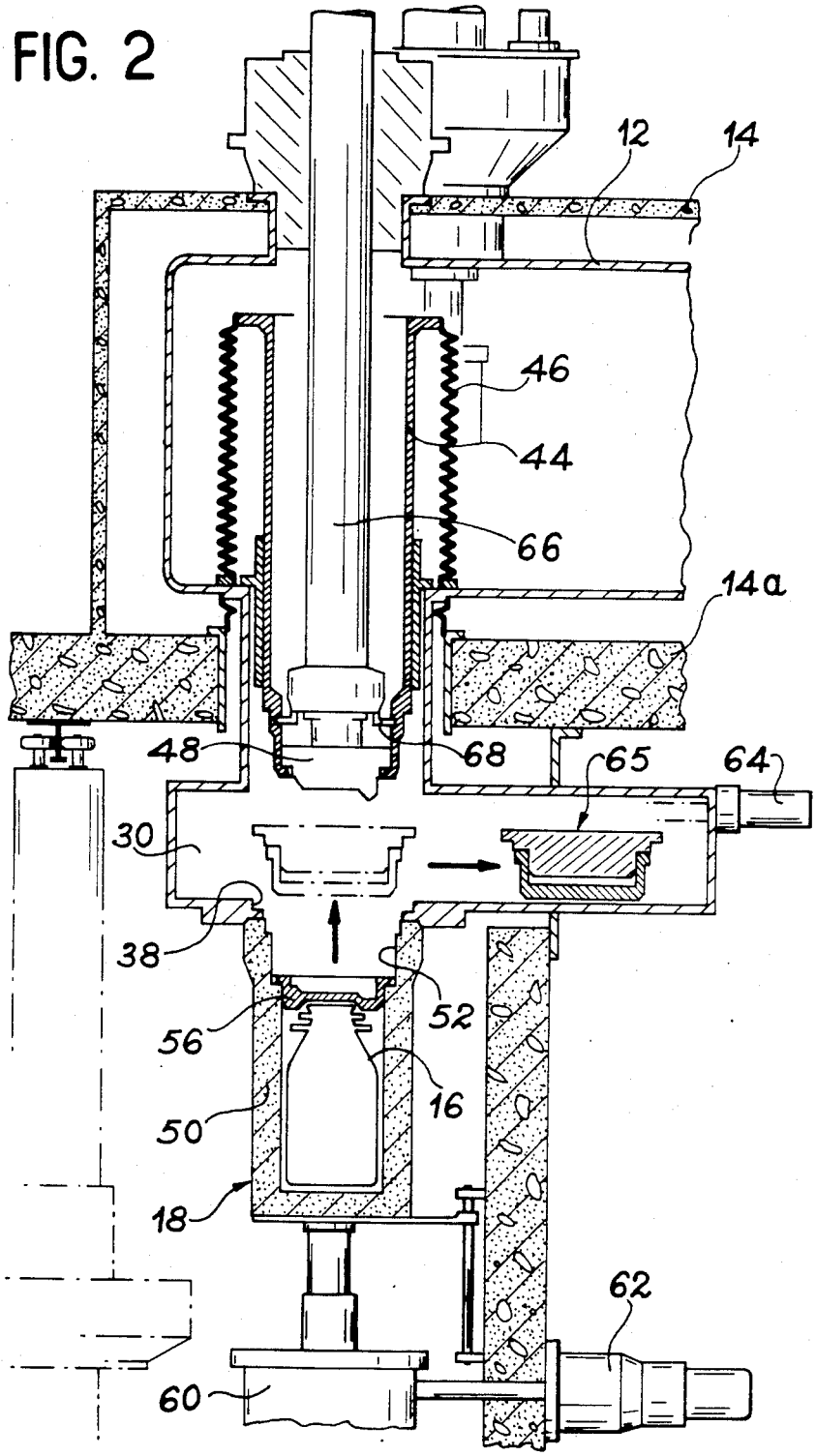
FIG. 2. A view comparable to FIG. 1 showing the transfer device according to the invention in the position which it occupies after removing the first double door.

A locking of the upper end of the container envelope 50 on flange 36 is not necessary, in view of the action of lifting mechanism 60. However, it is useful to provide external handling means for locking doors 40 and 54 to one another and for unlocking each of these doors from the flange corresponding thereto. These handling means are very diagrammatically shown in FIG. 1 and are designated by reference numeral 63. They are placed within the chamber 30 and also ensure the transfer of the double door 65 constituted by doors 40 and 54 to the side with reference to opening 38, as illustrated in FIG. 2. These handling means 63 can be constituted by a single carriage carrying gripping and lifting fingers, the displacement of the fingers and the carriage being controlled by motors 64.

The double door 65 formed by doors 40 and 54 is placed in chamber 30, so as to disengage openings 38 and 52 respectively formed in chamber flange 36 and container envelope 50, so that the mobile skirt 44, which was previously in the raised position in order to free the passage of the handling means 63, can now be moved vertically downwards.

Figure 3:
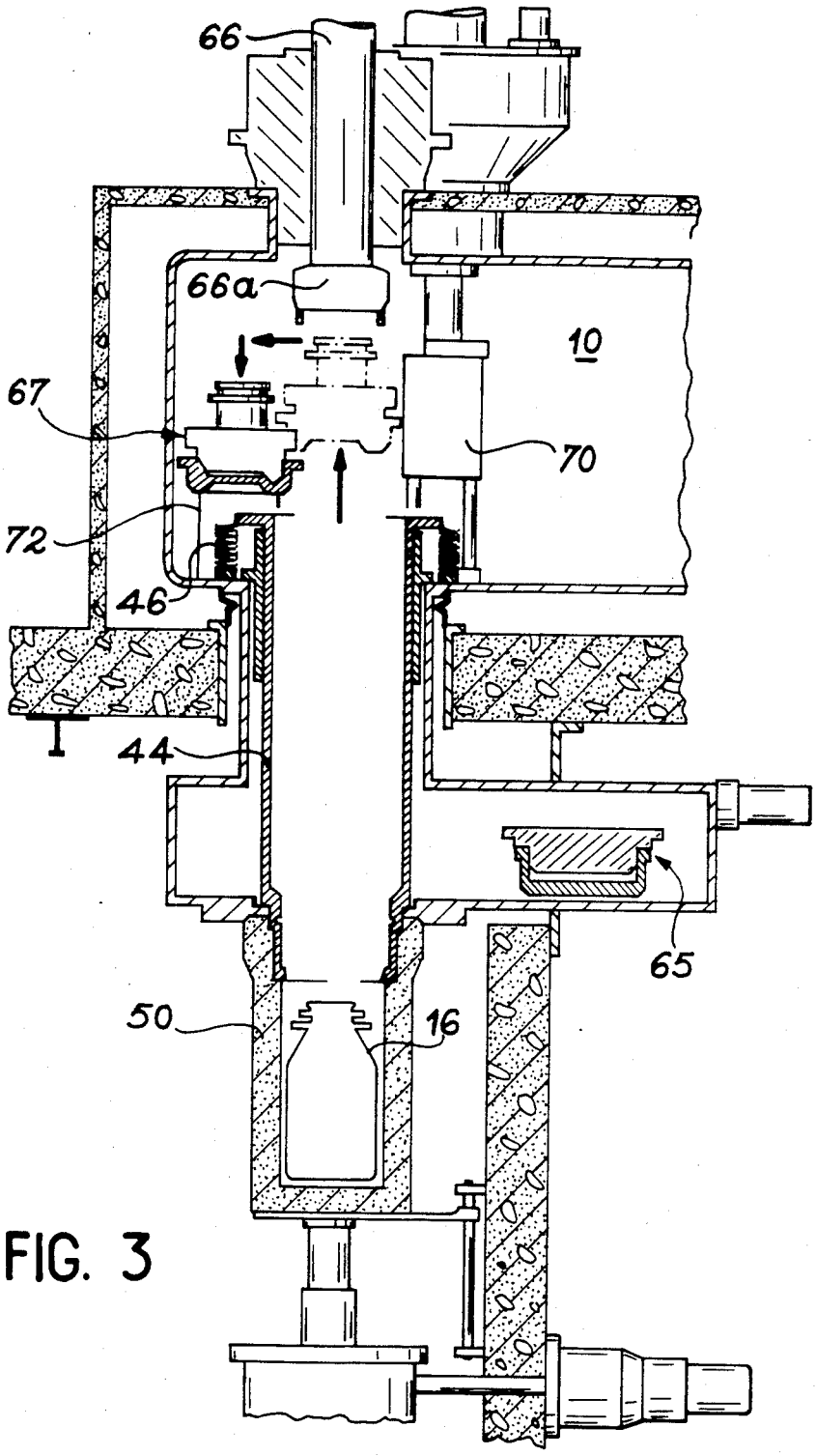
FIG. 3. A view comparable to FIGS. 1 and 2 showing the transfer device according to the invention after removing the second double door.

As illustrated in FIG. 3, this displacement of skirt 44 has the effect of bringing the lower edge thereof into a bearing position on the upper edge of the container envelope 50. Simultaneously, door 48 sealing the lower end of the skirt is engaged on the inner container door 56. On referring to FIG. 2, it can be seen that this operation is accomplished in the represented embodiment with the aid of a vertical pole 66 located along the vertical axis of skirt 44. The lower end of said pole 66 is fixed to skirt 44, e.g. with the aid of latches 68.

When the lower end of skirt 44 bears on the upper edge of container envelope 50, not shown locking means are put into use both for joining these two parts and for simultaneously joining doors 48 and 56. These locking means, which are also controlled by pole 66, can in particular be realised in accordance with the teaching of the French patent application entitled "Device for the tight connection of two enclosures" filed by the Applicant on the same date as the present application.

As is more particularly illustrated by FIG. 3, the lower end of the pole is then disengaged from skirt 44 and double door 67 constituted by the assembled doors 48 and 56 is raised up into the confinement enclosure 10. A horizontal manipulator 70 placed within the confinement enclosure 10 then grasps the double door for placing it on an appropriate support 72 arranged laterally with respect to the vertical passage formed by skirt 44.

At this stage of the transfer, the two tight barriers have been cleared and the interior of the container envelope 50 containing the contaminated jar 16 is directly linked by skirt 44 with the interior of enclosure 10. Pole 66 is then once again vertically lowered within skirt 44, so as to grasp by its terminal grapnel 66*a* the contaminated jar 16.

Figure 4:
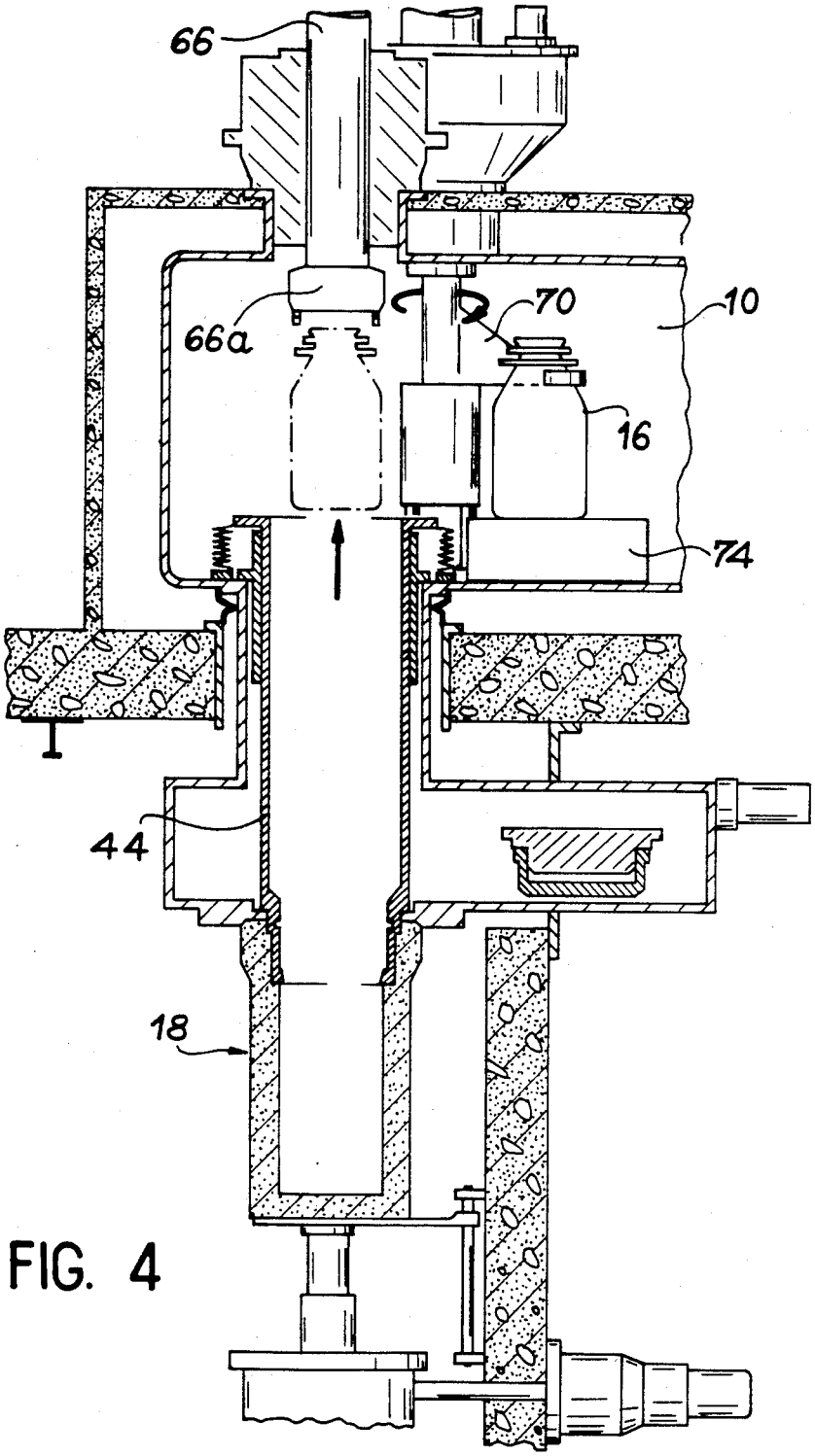
FIG. 4. A view comparable to FIGS. 1 to 3 showing the transfer device according to the invention in the position which it occupies after transferring a contaminated receptacle from the container to the confinement enclosure.

As illustrated in FIG. 4, jar 16 is then brought into enclosure 10 by again raising pole 66, followed by once again using horizontal manipulator 70, which places the contaminated jar 16 on a support 74 provided for this purpose within enclosure 10.

Obviously, the reverse transfer of jar 16 from contaminated enclosure 10 to the interior of container 18 can be performed in a similar manner and by reversing the operations described hereinbefore.

According to another feature of the invention and more particularly illustrated by FIG. 1, a ventilation/-filtration circuit 76 communicating with chamber 30 makes it possible to permanently renew the atmosphere contained within the latter by means of a pump 78 and, if appropriate, to filter said atmosphere by a bank of filters 80. Preferably, a contamination checking device 82 is placed in circuit 76. This device makes it possible to control the evolution of the possible contamination of chamber 30 resulting from a failure of the tight barrier formed between the latter and the confinement enclosure 10.

Cascade vacuums or underpressures are provided from the cell 20 (at atmospheric pressure) up to the confinement enclosure 10. Thus, the latter is under a vacuum compared with chamber 30, which is itself under a slight vacuum compared with cell 20.

Obviously, the invention is not limited to the embodiment described in exemplified manner hereinbefore and covers all variants thereof. In particular, skirt 44 carrying door 48 separating the chamber from the confinement enclosure can be replaced by any mobile member making it possible to move said door 48 between a position in which it is spaced from door 40 and a position in which it engages door 56 of the container, whilst maintaining the seal between the chamber and the enclosure.

In the same way, the handling means making it possible to lock and unlock the two tight double door transfer systems used in the device according to the invention can be constituted by any known means which can be remotely manipulated. Thus, this manipulation can either be carried out by mechanisms located within the chamber and the enclosure and controlled from the outside, as in the described variant, or by gloves and equivalent systems engaged in the walls of the chamber and enclosure and making it possible to directly manipulate the locking systems of the double door without breaking the seal. This comment also applies to the device making it possible to move skirt 44 (or the mobile member corresponding thereto) between its two extreme positions.

It is finally pointed out that the transfer, which takes place vertically in the embodiment described, could also take place horizontally or obliquely, the handling means being adapted as a function thereof.

What is claimed is:

1. A transfer device with a double tight barrier between a container and a confinement enclosure, wherein it comprises a transfer chamber having a first opening issuing into the confinement enclosure and a second opening issuing out of said enclosure, the first and second openings normally being closed by first and second doors respectively; said container having an opening closed by an external door and by an internal door and which can be tightly engaged on the second opening of the chamber in order to link the latter with the container, following the removal of a first double door constituted by the external door of the container and by the second door of the chamber; and a movable wall common to the chamber and to the confinement enclosure, carrying the first opening of the chamber and whose displacement makes it possible to engage the latter tightly on the container opening, after removing the first double door, in order to link the container with the confinement enclosure after removing a second double door constituted by the inner door of the container and by the second door of the chamber.

2. A transfer device according to claim 1, wherein the mobile wall comprises a skirt, whereof one end defines the first opening of the chamber, the first and second openings of the chamber being positioned in facing manner along a common axis, said skirt being mobile parallel to said axis and connected to the walls of the chamber and the enclosure by sealing means.

3. A device according to claim 2, wherein the sealing means have at least one bellows, whereof the ends are respectively fixed to the skirt and to the walls of the chamber and the enclosure.

4. A device according to claim 1, wherein handling means are provided in the chamber for fitting and removing said first double door.

5. A device according to claim 1, wherein handling means are provided in the confinement enclosure for fitting and removing the second double door.

6. A device according to claim 1, wherein a ventilation/filtration circuit communicates with the chamber and comprises means for checking the atmosphere within the chamber.

7. A device according to claim 1, wherein cascade vacuums are provided between the confinement enclosure and the exterior, passing via the transfer chamber.

* * * * *